US007699046B1

(12) United States Patent
Benavides

(10) Patent No.: US 7,699,046 B1
(45) **Date of Patent: *Apr. 20, 2010**

(54) HANDBILL ASSEMBLY LAUNCHING SYSTEM

(76) Inventor: Armando W. Benavides, 2327 Castroville Rd., San Antonio, TX (US) 78237

( * ) Notice: Subject to any disclaimer, the term of this patent is extended or adjusted under 35 U.S.C. 154(b) by 0 days.

This patent is subject to a terminal disclaimer.

(21) Appl. No.: 12/111,700

(22) Filed: Apr. 29, 2008

Related U.S. Application Data

(63) Continuation-in-part of application No. 11/514,441, filed on Sep. 1, 2006, now Pat. No. 7,409,951.

(60) Provisional application No. 60/714,099, filed on Sep. 2, 2005.

(51) Int. Cl.
*F41B 11/00* (2006.01)

(52) U.S. Cl. ..... 124/56; 124/73

(58) Field of Classification Search ..... 124/56, 124/73

See application file for complete search history.

(56) References Cited

U.S. PATENT DOCUMENTS

| | | | | |
|---|---|---|---|---|
| 2,839,234 | A * | 6/1958 | O'Neil | 229/123.2 |
| 3,259,300 | A * | 7/1966 | Pietrzak et al. | 229/125.21 |
| 3,268,143 | A * | 8/1966 | Bolcato | 229/400 |
| 5,443,205 | A * | 8/1995 | Robotham et al. | 229/243 |
| 6,364,201 | B1 * | 4/2002 | Varano | 229/198.2 |
| 6,761,157 | B2 * | 7/2004 | Bartek | 124/56 |

* cited by examiner

*Primary Examiner*—J. W Eldred
*Assistant Examiner*—Gabriel J Klein
(74) *Attorney, Agent, or Firm*—George S. Gray

(57) ABSTRACT

A handbill is rolled to form a coil that is retained within a collapsible cup as it is ejected from an elongated tube and delivered to its destination. The collapsible cup has a cylindrical wall and a bottom member at one end that does not contribute to the structural strength of the cup. A variety of bottom members are provided with each having an exposed adhesive within the cup that is encountered when the handbill is inserted within the cup. The elongated tube is connected to a controllable source of pressurized fluid that is used to eject the handbill assembly from the tube. The handbill assembly and delivery system avoids the problems of prior assemblies and systems that projected cone-shaped paper flyers through the air.

14 Claims, 6 Drawing Sheets

HANDBILL ASSEMBLY LAUNCHING SYSTEM

CROSS-REFERENCE TO PRIOR APPLICATIONS

This application is a continuation-in-part from and claims priority from U.S. patent application Ser. No. 11/514,441, filed Sep. 1, 2006, now U.S. Pat. No. 7,409,951 and U.S. Provisional Patent Application Ser. No. 60/714,099, filed Sep. 2, 2005, the inventor for both applications being Armando W. Benavides.

BACKGROUND OF THE INVENTION

1. Field of the Invention

This invention relates generally to an assembly having handbill and delivery container components, and more specifically to such an assembly that is adapted for delivery by pneumatic ejection from a tube.

2. Background

The desire of every person who has walked the streets delivering flyers or handbills door-to-door is to have some way to magically transport the flyers to each doorstep. One attempt to address this desire is described in U.S. Pat. No. 3,345,977, issued Oct. 10, 1967 to L. F. Hall. The Hall patent discloses a device for projecting paper cones through the air.

An advertising circular, or leaflet, is rolled into a cone shape and secured in that shape by adhesive tape. The taped cone is then inserted into the breach of a tube and fitted over a nozzle that extends a substantial distance into the cone. Compressed gas is then selectively released through the nozzle to impinge on the inner conical end of the cone and propel it through the air to a desired destination.

The Hall system has several inherent disadvantages. First, in contradiction of the statements made in the Hall patent, the sharply pointed end of the paper cone presented a serious risk of injury when projected at high velocity from a tube. If the cone struck a child, or even an adult, in the head, eyes, throat, or other vulnerable area, within the first few feet after ejection from the tube, them was a significant risk of injury. Also, the Hall system was able to project only a single cone containing a single sheet of material. If more than one sheet was included in the cone, the sheets would have to be secured together to prevent unwinding during flight and accordingly the cone, and especially the tip of the cone, would have a much greater stiffness. This would undesirably increase the risk of injury if the cone were to strike a vulnerable object.

Another disadvantage of the Hall system is that the cones had to be precisely rolled so that the base of the cone would fit within the barrel of the tube and yet slide over the expanded conical base of the nozzle. Thus, a great deal of care was required in forming, rolling, and taping the cones.

A method for delivering newspapers and similar relatively heavy objects in residential areas is described in U.S. Pat. No. 3,653,538, issued Apr. 4, 1972 to Robert L. Lamar. The Lamar system uses a compressed air-powered mechanical ram to launch the objects according to a preselected sequence program. Although rather complicated, the Lamar system appears to be useful for delivering relatively large, heavy articles, such as newspapers. However, the mechanical launcher arrangement would not be effective for projecting lightweight articles such as handbills, flyers, circulars and the like, through the air.

A predecessor to the current invention is described in U.S. Pat. No. 5,553,599, issued Sep. 10, 1996, to the present inventor. Improvements to the predecessor system are described herein.

The present invention is directed to overcoming the problems set forth above, and to enhance the predecessor system provided by the current inventor in his previous patent. It is desirable to have a handbill assembly that is economical to produce and assemble, can be quickly and accurately delivered by ejection from a conventional tube connected to a source of compressed air, and poses no, or most very minimal, risk of injury to a person if struck by the assembly during delivery. It is also desirable to have such an assembly that is easily crushed if inadvertently stepped on after delivery. It is also desirable to have an enhanced capability to retain a handbill within the assembly. It is also desirable for the assembly to be easily assembled.

SUMMARY OF THE INVENTION

In accordance with one aspect of the present invention, a handbill assembly comprises a cup member and a handbill. The cup member has a readily collapsible cylindrical wall having a predefined internal diameter, and a nonstructural bottom member that extends across one end of the cylindrical wall and forms a closed bottom of the cup. The other end of the cup member is open. The handbill is formed of one or more sheets of paper that are rolled to form a coil that has an unrestrained diameter that is greater than the inside diameter of the cup member. At least one third of the coiled handbill is disposed within the cup member.

In another aspect of the present invention, a handbill delivery system includes an elongated tube having spaced apart open and closed ends and a predetermined internal diameter. A control valve is disposed in fluid communication with a source of compressed fluid and the closed end of the elongated tube. The handbill delivery system also includes a collapsible cup having a cylindrical wall that has an external diameter that is less than the internal diameter of the elongated tube and a pair of spaced apart ends. The collapsible cup also has a nonstructural covering across one of its spaced apart ends that forms a closed bottom of the cup. In my present invention I have enhanced the handbill retention capabilities of the cup by adding adhesive to the nonstructural covering to areas of the covering exposed to the area within the cylindrical wall of the cup, such that the handbill encounters, and is held by, such additional adhesive, when the handbill is inserted within the cup. When the collapsible cup is assembled in the elongated tube, the closed bottom of the cup is positioned in a direction facing the closed end of the elongated tube.

Further, in my present invention, I have enhanced the handbill retention capabilities of the cup by making additional bottom members available, some of which have extensions for adhesively securing the bottom member to the cup outer side, and some of which are formed as plug for insertion into the cup.

Other features of the handbill assembly include the collapsible cylindrical wall of the cup member being formed of cardboard, and the nonstructural bottom member being formed of single ply paper.

Other features of the handbill delivery system include the elongated tube having an opening in the tube adjacent the closed end for receiving a collapsible cup containing a handbill, and a sleeve that is slidably disposed on the elongated tube that is movable to a covering position over the opening.

In exemplary embodiments of my present invention, I have provided a handbill assembly for a pneumatic ejection system, comprising: a cup member consisting of a readily collapsible cylindrical wall, the cylindrical wall having an exterior surface, said cup member having a predefined internal diameter and two ends spaced apart at a predetermined distance, a nonstructural bottom member extending across one of said ends of the cylindrical wall and forming a closed end of said cup, and an open top at the other of said ends, said bottom member having a substantially circular planar portion and a plurality of elongated extensions joining said circular planar portion, said extensions having an adhesive, said extensions being foldable for adhesively secured disposition against the cylindrical wall exterior surface, said bottom member planar portion further having an adhesive exposed within said cup; and a handbill consisting of at least one sheet of paper rolled to form a coil having a length no more than about three times as long as the spaced distance between the ends of the cylindrical wall of the collapsible cup, a first portion extending along at least one-third of said coil length, a second portion extending along the remainder of said length, and an unrestrained diameter greater than the internal diameter of the cylindrical wall component of said cup, said first portion being disposed within the cup and said second portion extending outwardly from the open end of said cup, said first portion having an inserted end, the inserted end encountering at least some of the bottom member exposed adhesive.

In some exemplary embodiments of the present invention the bottom member planar portion adhesive is configured to leave part of the bottom member planar portion without exposed adhesive.

In some exemplary embodiments of the present invention the adhesive on each of the plurality of elongated extension adhesive is configured to leave part of each of the elongated extensions without adhesive.

In some exemplary embodiments of the present invention the number of elongated extensions is two.

In some exemplary embodiments of the present invention the number of elongated extensions is four.

In some exemplary embodiments of the present invention the nonstructural bottom member of said cup member is formed of single ply paper.

In exemplary embodiments of my invention, I have provided a handbill delivery system, comprising: an elongated tube having a closed end, an open end spaced from said closed end, and a predetermined internal diameter; a source of compressed fluid; a control valve in fluid communication with said source of compressed fluid and the closed end of said tube; a collapsible cup consisting of a cylindrical wall, the cylindrical wall having an exterior surface, said cup having an external diameter less than the internal diameter of said elongated tube and a pair of ends spaced apart at a predetermined distance, a nonstructural covering across one of said spaced ends forming a closed bottom of said collapsible cup, said closed bottom being disposed in a position facing the closed end of said elongated tube when said cup is assembled in the elongated tube, said covering further having a substantially circular planar portion and a plurality of elongated extensions joining the circular planar portion, the extensions having an adhesive, the extensions being foldable for adhesively secured disposition against the cylindrical wall exterior surface, said covering circular planar portion further having an adhesive exposed within the cup.

In some exemplary embodiments of the present invention the covering circular planar portion adhesive is configured to leave part of the circular planar portion of the covering without exposed adhesive.

In some exemplary embodiments of the present invention the adhesive on each of the plurality of elongated extension adhesive is configured to leave part of each of the elongated extensions without adhesive.

In some exemplary embodiments of the present invention the number of elongated extensions is two.

In some exemplary embodiments of the present invention the number of elongated extensions is four.

In exemplary embodiments of my invention, I have provided a handbill assembly for a pneumatic ejection system, comprising: a cup member consisting of a readily collapsible cylindrical wall, said cup member having: a predefined internal diameter, an inside surface, and two ends spaced apart at a predetermined distance; a nonstructural bottom member having a substantially planar and circular portion and a wall portion about the planar portion, the bottom member being sized such that the bottom member is closely received by one of said ends of the cylindrical wall forming a closed end of said cup, the bottom member planar portion extending across said end of the cylinder wall, and at least part of the bottom member wall portion bearing upon the cylindrical wall inside surface; and an open top at the other of said ends, said bottom member planar portion having an adhesive exposed within the cup; and a handbill consisting of at least one sheet of paper rolled to form a coil having a length no more than about three times as long as the spaced distance between the ends of the cylindrical wall of the collapsible cup, a first portion extending along at least one-third of said coil length, a second portion extending along the remainder of said length, and an unrestrained diameter greater than the internal diameter of the cylindrical wall component of said cup, said first portion extending being disposed within the cup and said second portion extending outwardly from the open end of said cup, said first portion having an inserted end, the inserted end encountering at least some of the bottom member exposed adhesive.

In some exemplary embodiments of the present invention the bottom member planar portion adhesive is configured to leave part of the bottom member without exposed adhesive.

In some exemplary embodiments of the present invention the nonstructural bottom member of said cup member is formed of single ply paper.

The foregoing features and advantages of my invention will be apparent from the following more particular descriptions of exemplary embodiments of the invention as illustrated, in some embodiments, in the accompanying drawings.

DETAILED DESCRIPTION OF EXEMPLARY EMBODIMENTS

Figure 1:
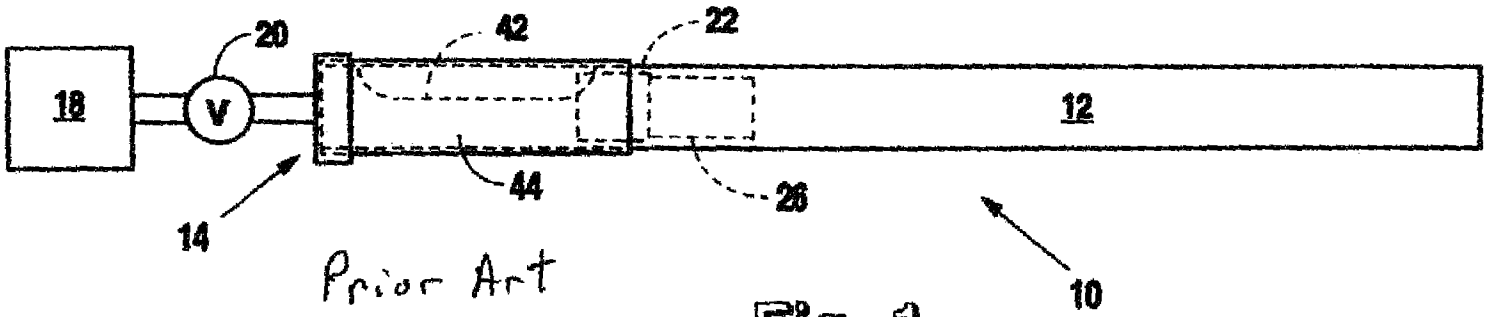
Fig. 1 Prior Art
FIG. 1 is a schematic view of the handbill delivery system embodying the present invention.

An exemplary handbill delivery system 10 embodying the present invention is shown schematically in FIG. 1, and includes an elongated tube 12 having a closed end 14 and an open end 16 spaced from the dosed end 14. The preferred embodiment of the present invention is described below with specific reference to an illustrative example in which the elongated tube 12 is formed of conventional PVC plastic pipe having a nominal diameter of 3.175 cm (11/4 in). The actual internal diameter of the pipe forming the tube 12 is 3.5 cm (13/8% in), and in the illustrative example described herein, has a length extending between the spaced ends 14,16 of about 91 cm (3 ft).

The handbill delivery system 10 also includes a source of compressed fluid 18, such as a portable air compressor or pressurized tank of air or other gas. A control valve 20 to control the flow of compressed fluid from the source 18 to the closed end 14 of the elongated tube 12 is connected by a flexible pressure hose to both components. In the illustrative example of the preferred embodiment of the present invention, the source of pressurized fluid 18 is a portable, gas engine driven, air compressor having a rating of 9.7 cfm (0.046 m.sup.3/s) of compressed air at a pressure of 90 psi (62 N/cm.sup.2). A pressure regulator, not shown, is set to provide 100 psi (69 N/cm.sup.2) supply pressure to the closed end 14 of the tube 12. The control valve 20 is a trigger actuated valve commonly used with a conventional blow nozzle.

Figure 2:
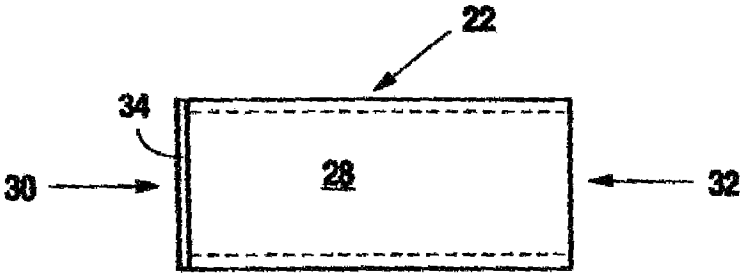
Fig. 2 Prior Art
FIG. 2 is an elevational view of the cup member comprising one component of the handbill assembly embodying the present invention.

A key component of the handbill delivery system 10 is a collapsible cup 22, shown in FIG. 2, that forms one component of a handbill assembly 24. The term "cup" as used herein means a receptacle having an open top and a closed bottom. The terms "collapsible cup" and "readily collapsible wall" mean a cup or cup wall that can be easily crushed, or collapsed along its length if stepped on, even by a child. More specifically, the terms mean that the cup or cup wail will collapse when a static load of 6.8 kg (15 lbs) is applied to the respective structure. This feature of the present invention is important to present slipping in the event someone should step on a handbill assembly 24 that may be lying on a porch, sidewalk or driveway after delivery. If the cup 22, or the walls of the cup, are too rigid, the cup 22 will resist crushing and could roll, causing a person stepping on the cup to lose their balance. For this reason, it is important that the cup 22 itself and, as described below in more detail, its wall be readily collapsible.

As best shown in FIG. 2, the collapsible cup 22 embodying the present invention has a readily collapsible cylindrical wall 28, or tube, that is preferably constructed of lightweight cardboard or pasteboard. Cardboard or pasteboard are the preferred materials for the cup because they are economical and environmentally benign. However, the cup 22 may be constructed of other materials, such as plastic or metal foil, if the resultant structure is readily collapsible as defined above. The cylindrical wall 28 has predefined internal and external diameters, and a length that extends between a first end 30 and a spaced second end 32. Preferably, the collapsible cylindrical wall 28 has an internal diameter of from about 1.27 cm (0.5 in) to about 5.08 cm (2.0 inch), a wall thickness of from about 0.1 cm (0.04 in) to about 0.4 cm (0.16 in), and a length of from about 2.5 cm (1.0 in) to about 10.2 cm (4.0 in). In the illustrative example describing the preferred embodiment of the present invention, the internal diameter of the collapsible cylindrical wall 28 is about 3.0 cm (1.18 in), the external diameter about 3.4 cm (1.34 in), the wall thickness about 0.2 cm (0.08 in), and the length about 5.1 cm (2.0 in). Thus the outside diameter of the cylindrical wall 28 is only 0.1 cm (0.04 in) less than the internal diameter of the elongated tube 12, thus assuring minimal loss of pressurized fluid around the periphery of the cup member 22 during ejection. Preferably, the length of the cup member 22 is from about 1.5 to 4.0 times the internal diameter of the cylindrical wall 28 of the cup 22. In the above illustrative embodiment, the length of the cup member 22, defined as the distance between the spaced ends 30,32, is about 1.7 times the internal diameter of the cylindrical wall 28.

A bottom member 34 provides a nonstructural covering across the first end 30 of the collapsible cup member 22. The term "nonstructural" as used herein with respect to the bottom member 34 means that the bottom member 34 does not add any significant structural strength, or resistance to crushing, to the cylindrical wall 28. This feature of the present invention is important to assure that the cup member 22 retains it "readily collapsible" characteristics as described above.

Figure 3:
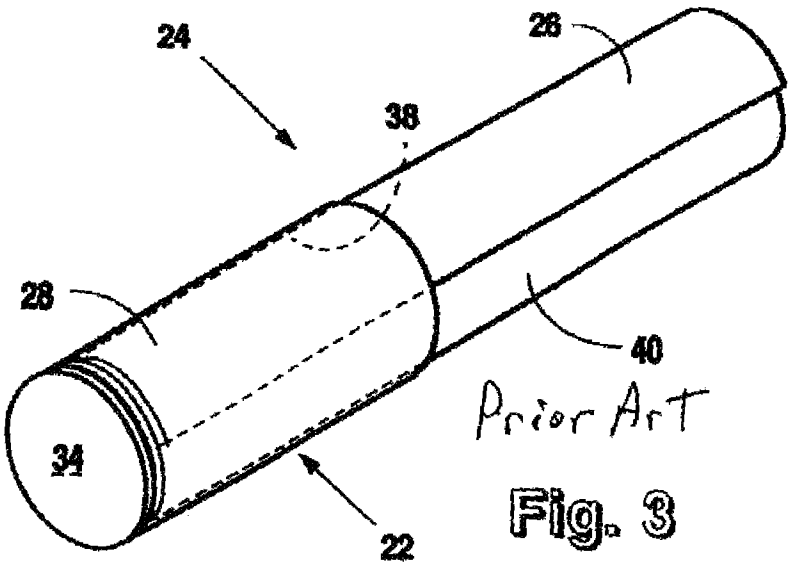
Fig. 3 Prior Art
FIG. 3 is a perspective view of the handbill assembly embodying the present invention.
Figure 4:
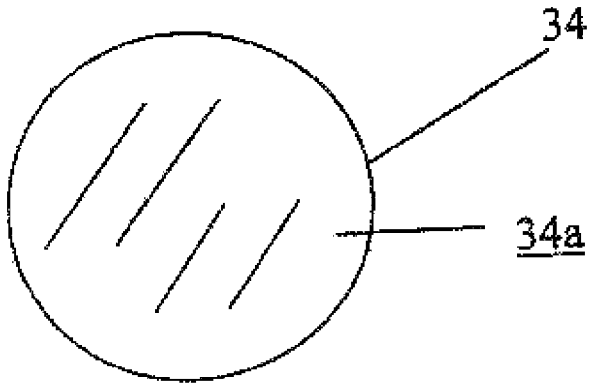
FIG. 4 is a frontal view of an exemplary embodiment of the nonstructural bottom member with the additional adhesive shown across its diameter.

In the preferred embodiment of the present invention, the bottom member 34 is a circular disk having an diameter substantially equal to the outside diameter of the cylindrical wall 28 and constructed of single ply paper having a standard weight of 50 lbs (22.7 kg). The single ply paper is adhesively attached to the first end 30 of the collapsible cup 22 by paste or glue. The bottom member 34 should have sufficient tear resistance to avoid splitting when impinged upon by compressed air during ejection from the elongated tube 12, yet not be so tightly adhered or structurally robust that it undesirably increases the crushability, or collapsibility, of the cylindrical wall 28. For these reasons, it is preferred that the bottom member be constructed of single ply paper having a standard weight of at least 16 lbs (7.3 kg) and no more than 110 lbs (49.9 kg). Alternatively, the bottom member 34 may be formed of a thin disk having a diameter substantially equal to the interior diameter of the cylindrical wall 28 and retained by either a nonstructural adhesive or by crimping a portion of the cylindrical wall 28 over the disk. In another arrangement, the bottom member 34 may be formed by crimping the cylindrical wall 28 to form a closure across the first end 30 similar to the crimped end of a shotgun shell or container for B-Bs. In this exemplary embodiment of my invention, and as illustrated in FIG. 4, an adhesive 34*a* is added to at least part of the bottom member 34, such that the adhesive is encountered by one end of the coiled handbill 26, when inserted in the manner illustrated in FIG. 3. In another exemplary embodiment, illustrated in FIG. 5, the bottom member 34 has additional adhesive 34*b* placed over only a portion of the bottom member inside surface, but in a manner such that the handbill 26 will encounter the adhesive portion. In the exemplary embodiment shown in FIG. 5, the adhesive is placed in a band across the bottom member 34. In other exemplary embodiments of the present invention, different arrangements and positionings of the additional adhesive may be used, leaving part of the bottom member inside surface without adhesive, as long as the additional adhesive is exposed to contact with the handbill assembly when inserted. The only effect of the less than complete coverage of the exposed bottom member surface being a reduction in the handbill retention capability.

In another arrangement, the cup member 22 may be formed of papier-mache with the bottom member 34 integrally formed with the cylindrical wall 28 as a single molded article. Regardless of the construction of the bottom member 34, it is important that the bottom member 34 not disadvantageously contribute to the crush resistance of the cup member 22.

The second end 32 of the cup member 22 is open and serves as a receiver for the handbill 26. The term "handbill" as used herein means one or more sheets of a flyer, circular, leaflet, notice, placard, advertisement, commercial document or other paper. In forming the handbill assembly 24 embodying the present invention, the handbill 26 is rolled along either its width or length to form a coil having an unrestrained diameter that is greater than the internal diameter of the cylindrical wall 28 of the cup member 22. The paper, or papers, comprising the handbill 26 are loosely rolled and inserted into the second end 32 of the cup member 22 where, upon release, the rolled coil expands against the interior surface of the cylindrical wall 28 with sufficient force to retain the handbill 26 in the cup member 22 during ejection from the elongated tube 12 and subsequent flight through the air to its delivery destination. Upon insertion in the cup 22, a first portion 38 of the coiled handbill 26, extending along its coiled length, is positioned within the cup 22. To assure retention of the handbill 26 in the cup during ejection, flight and delivery, the first portion 38 of the rolled, or coiled, handbill 26 should be at least ⅓ of the total coiled length of the handbill 26, with the remaining, or second, portion 40 extending outwardly from the second end 32 of the cup 22. In the illustrative example, the handbill 26 includes two sheets of heavy weight paper, one measuring 10.8 cm (41/4 in) by 27.9 cm (11 in), and the other sheet measuring 9.5 cm (33/4 in) by 21.6 cm (81/2 in), and having a combined weight of 8.5 g (0.3 oz).

Generally, several sheets of paper or handbills 26, depending upon their size and weight, can be rolled simultaneously, and inserted as a unit into the cup 22. However, there are several important considerations that should be addressed. First, the number of papers 26 inserted into the cup member 22 should not be so great as to inhibit the collapsibility of the cup member 22. Secondly, the total weight of the handbill assembly 24, including both cup member 22 and handbill 26, should not be so heavy as to be harmful if it should strike a person, window, or other structure during flight. For this reason, the total weight of the handbill assembly 24 should not exceed a few ounces. However, the total weight of the handbill assembly 24 must be sufficient to provide adequate throw, distance. Preferably, the handbill assembly 24 has a weight of at least 5.7 g (0.2 oz), but no more than 113 g (4.0 oz).

In the illustrative embodiment described above, the handbill 26 comprises two sheets of heavy paper weighing about 8.5 g (0.3 oz), and the total weight of the handbill assembly 24, including the collapsible cup member 22, is about 17 g (0.6 oz). The handbill 26 was rolled with fire smaller sheet inside the larger sheet so that the length of the coiled roll was the width of the larger sheet, i.e., 10.8 cm (41/4 in). To assure proper balance of the handbill assembly 24 during ejection, rotation during flight, and cup-end delivery, it is desirable that the center of gravity, or balance point, of the handbill assembly 24 be positioned between the spaced ends 30,32 of the cup member 22. This means that the second portion 40 of the handbill 26 extending outwardly of the second end 32 of the cup 22 should not have a weight that is greater than the combined weight of the first portion 38 of the handbill 26 and the cup member 22.

In carrying out the delivery of handbills 26 using the delivery system 10 embodying the present invention, the elongated tube 12 has a longitudinal opening 42 adjacent the closed end 14 of the tube 12. The opening 42 has a width and length sufficient to receive one of the handbill assemblies 24. Once inserted, the received end of the handbill 26 will encounter the additional adhesive 34*a*, the adhesive further securing the handbill within the tube 12. When properly inserted, the handbill edges encounter the adhesive such that the process of adhering the handbill to the bottom member does not unduly alter or mar the appearance of the handbill. During ejection of the handbill assembly 24 from the elongated tube 12, the opening 42 is covered by sleeve 44 that is slidably mounted on the exterior of the tube 12 and positioned at a first position as shown in FIG. 1. The opening 42 is accessed for insertion of the handbill assembly 24 by sliding the sleeve 44 along the tube, toward the open end 16, to a second position spaced from the opening 42.

An important advantage of the exemplary handbill delivery system 10 embodying the present invention is that the handbill assembly 24 does not need to be precisely positioned within the elongated tube 12, as was required in the aforementioned system for delivering a paper cone. The handbill assembly 24 is inserted through the opening 42 with the bottom member 34 of the cup 22 facing toward the closed end 14 of the tube 12. The handbill assembly 24 may be inserted anywhere along the opening 42 and either left at that position in the tube 12, or even placed forward of the opening 42. It is not necessary that the bottom member 34 of the cup member 22 be positioned in contact with, or even closely adjacent, the closed end 14 of the elongated tube 12. After insertion of the handbill assembly 24 into the elongated tube 12, the sleeve 44 is moved to its first, or covering position over the opening 42. When it is desired to eject the handbill assembly, the valve 20, connected to a pressure line from the air compressor 18, is momentarily opened to admit pressurized fluid into the interior of the tube 12 through the pressure line connected to a fitting in the closed end 14 of the tube 12. The pressurized air then ejects the handbill assembly 24, the second portion 40 of the handbill 26 end first, through the open end 16 of the elongated tube 12. Immediately after leaving the open end 16 of the tube 12, the handbill assembly 24 rotates, or tumbles, end for end so that the cup end of the assembly 24 lands first. This feature assures good aerodynamic flow around the handbill assembly 24 during flight and makes it possible for an operator of the delivery system 10 to accurately spot the delivery position of the handbill assembly 24.

In the above described illustrative embodiment of the present invention, the elongated tube 12 has a length of about 91 cm (3.0 ft), and is capable, with the above stated 100 psi (69 N/cm.sup.2) supply pressure, of projecting the described handbill assembly 24 having a weight of about 17 grams (0.6 oz), a distance of about 15 m (50 ft). It has been found that the flight distance of the ejected handbill assembly 24 can be increased by using a higher supply pressure or a longer tube 12, or a combination of both. Similarly, the flight distance may be decreased by either lowering the supply pressure or shortening the length of the elongated tube 12, or a combination of both.

The handbill delivery system 10 embodying the present invention is particularly useful for delivery handbills, flyers, circulars, etc. from a moving vehicle. The compressed fluid source 18, either a small portable air compressor or pressurized tank, can be conveniently carded in the back of a pickup truck, and the pressure hose fed through a window, or other opening, into the cab. The elongated tube can be easily directed through an open window and, by selective triggering of the valve 20, project a handbill assembly 24 through the air and deposit it at a selected destination. With only minimal practice, an operator can become quite proficient at precisely placing a handbill in the middle of a designated target. The handbill delivery system 10 is easy to construct and maintain, and is assembled of easily obtained, relatively inexpensive components.

The handbill assembly 24 embodying the present invention provides an aesthetically desirable, safe, and economical arrangement for handbills 26. The handbill assembly has no pointed ends that could cause personal injury, and is easily crushable if accidentally stepped on. Furthermore, when constructed of cardboard and paper as described in the preferred embodiment of the present invention, the handbill assembly 24 is not environmentally disadvantageous. This characteristic is even more apparent because of the enhanced capability of the cup to retain the handbill, thus reducing the occurrence of handbills coming out of the cup and littering the premises.

Figure 5:
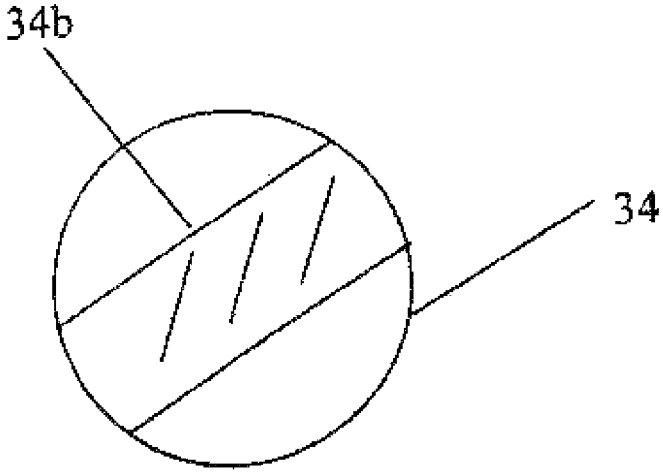
FIG. 5 is a frontal view of an exemplary embodiment of the nonstructural bottom member with the additional adhesive shown in a diagonally positioned bar across its diameter.
Figure 6:
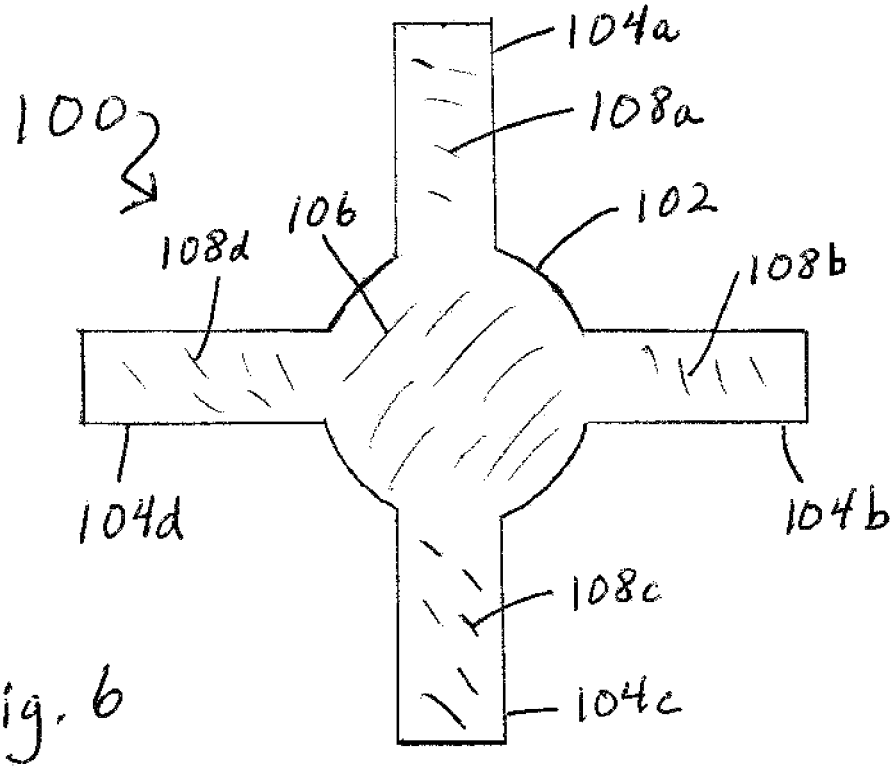
FIG. 6 is a front view of the forward side of an exemplary embodiment of the nonstructural bottom member having four elongated extensions.
Figure 7:
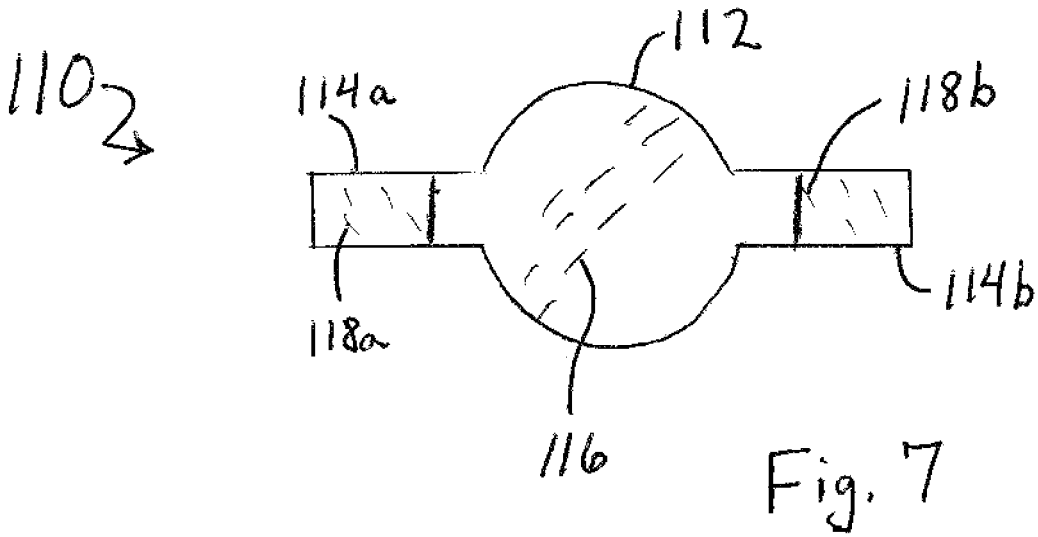
FIG. 7 is a front view of the forward side of an exemplary embodiment of the nonstructural bottom member having two elongated extensions.
Figure 8:
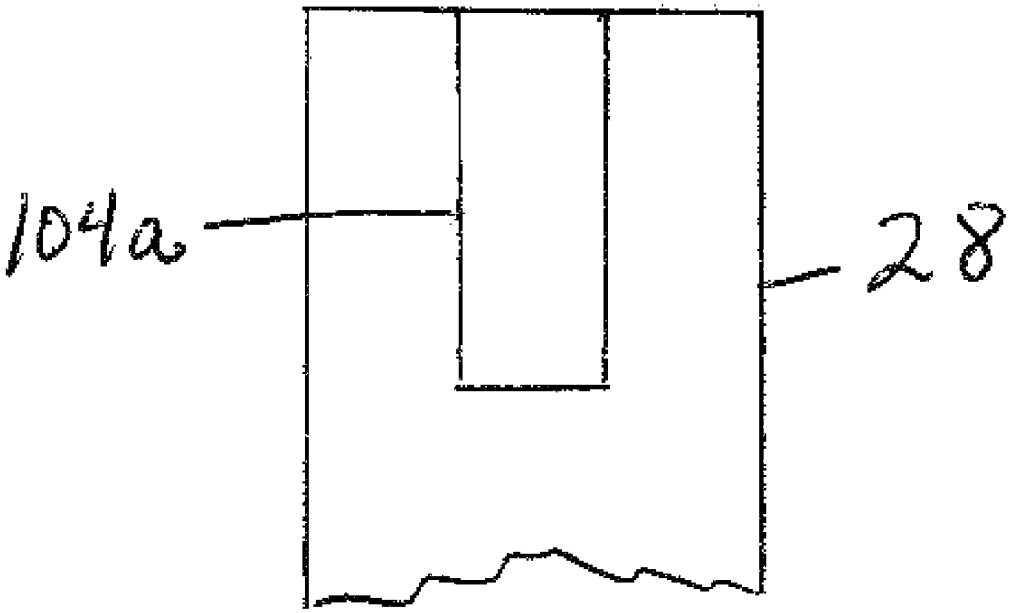
FIG. 8 is a side view of the exemplary embodiment of the bottom member of FIG. 6, with one bottom member elongated extension adhesively secured to the cup side.

Turning now to FIGS. 6-8, wherein exemplary embodiments of the present invention are illustrated and are shown to include a replacement bottom member 100 for the previously described bottom member 34. Bottom member 100 includes a substantially circular center portion 102. In some exemplary embodiments the center portion 102 has a diameter substantially equal to the diameter of the cup 22, and in some exemplary embodiments the center portion is substantially planar. As illustrated for the exemplary embodiment depicted in FIG. 6 and FIG. 8, a plurality of elongated extensions 104*a-d* extend from the center portion 102 and in some exemplary embodiments the number of ears is four. An adhesive 106, as described above with respect to the exemplary embodiments illustrated by FIG. 4 and FIG. 5, is present on at least part of the forward side of the center portion 102, such that the adhesive is encountered by one end of the coiled handbill 26, when inserted in the manner similar to that illustrated in FIG. 3. An adhesive 108*a-d* is also present on the forward side of the elongated extensions, such that when the user places the center portion 102 proximate the cup 22 opening, the elongated extensions are brought forward such that the elongated extension adhesive 108*a-d* adhesively joins all or part of each of the elongated extensions 104*a-d* to the side 28 of the cup 22, as shown for one representative elongated extension 104*a* in FIG. 8. This secures the center portion against the cup end and positions the center portion adhesive 106 to encounter the one end of the coiled handbill 26.

For exemplary embodiments of the type illustrated in FIG. 7, the bottom member 110 includes a substantially circular center portion 112 from which extends two elongated extensions 114*a-b*. In some exemplary embodiments the center portion is substantially planar. An adhesive 116, as described above with respect to the exemplary embodiments illustrated by FIG. 4 and FIG. 5, is present on at least part of the forward side of the center portion 112, such that the adhesive is encountered by one end of the coiled handbill 26, when inserted in the manner similar to that illustrated in FIG. 3. An adhesive 118*a-b* is also present on the forward side of the elongated extensions, such that when the user places the center portion 112 proximate the cup 22 opening, the elongated extensions are brought forward such that the elongated extension adhesive 118*a-b* adhesively joins all or part of the elongated extensions 114*a-b* to the side 28 of the cup 22. FIG. 8 is also representative of the elongated extensions joinder to the cup side 28. This secures the center portion 112 against the cup end and positions the center portion adhesive 116 to encounter the one end of the coiled handbill 26.

With respect to exemplary embodiments illustrated in FIGS. 6-8, the coverage of the adhesives 106,108*a-d*,116, 118*a-b* may cover substantially all of the center portions 102,112 and/or the elongated extensions 104*a-d*,114*a-b*. For example, substantial adhesive coverage is illustrated in FIG. 6 for both the center portion 102 and the elongated extensions 104*a-d*, and limited adhesive coverage is illustrated in FIG. 7 for both the center portion 112 and the elongated extensions 114*a-b*.

Figure 9:
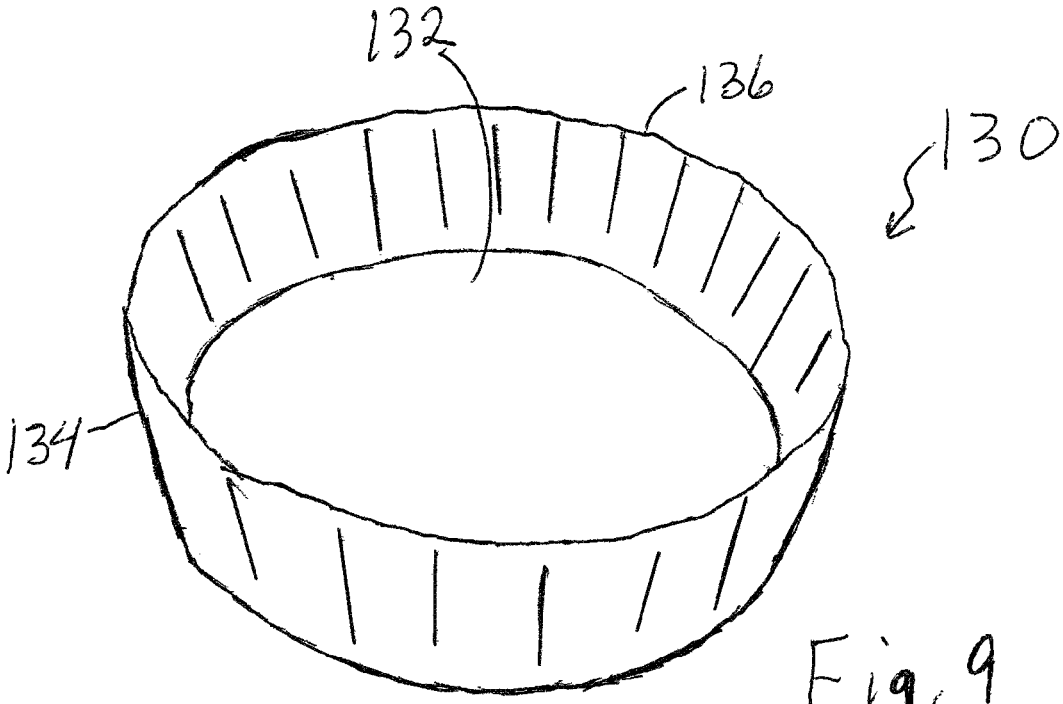
FIG. 9 is a perspective view of an exemplary embodiment of a nonstructural bottom member.
Figure 10:
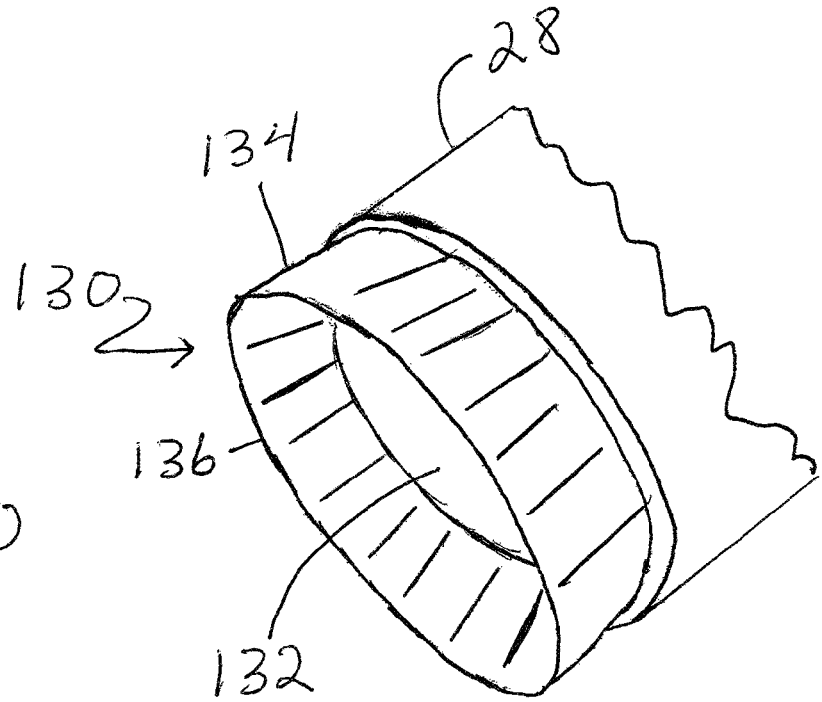
FIG. 10 is a perspective view of an exemplary embodiment of the nonstructural bottom member of FIG. 9 as it is being inserted into the cup end.
Figure 11:
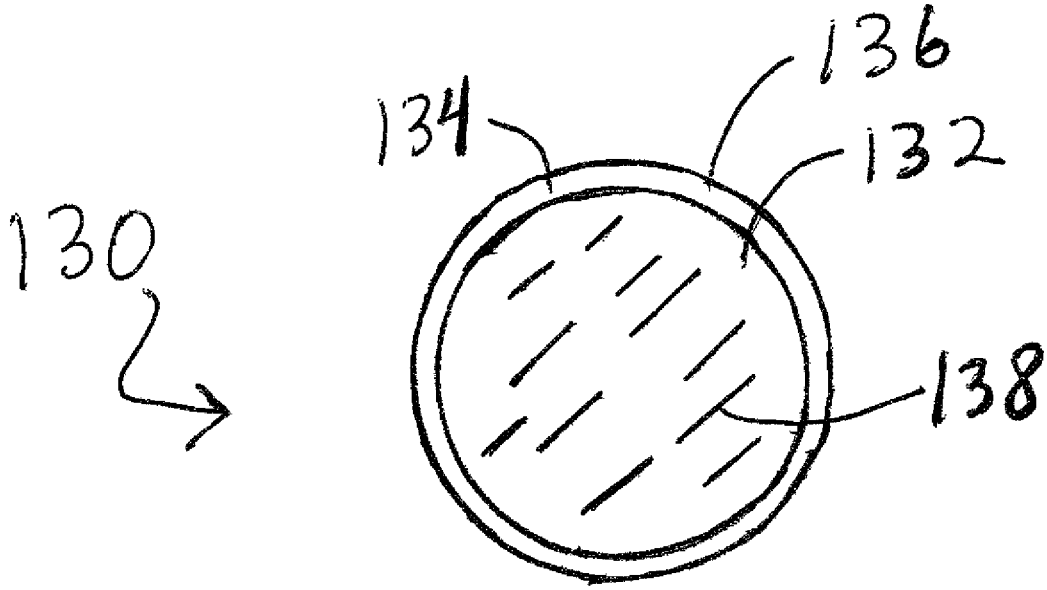
FIG. 11 is a perspective view of an exemplary embodiment of the forward side of the nonstructural bottom member of FIG. 9 with adhesive shown.

Turning now to FIGS. 9-11, wherein exemplary embodiments of the present invention are illustrated and are shown to include a replacement bottom member 130 for the previously described bottom member 34. Bottom member 130 has a substantially circular center portion 132 having a diameter substantially the same as the cup 22 diameter. Extending from the center portion 132 outer edge is a wall portion 134 having a top edge 136, the center portion 132 and wall portion 134 are respectively sized to be closely received and securable within the cup 22 end, as illustrated in FIG. 10, wherein the bottom member 130 is being inserted into the cup 22.

Insertion is complete when the wall portion outer edge 136 is substantially flush with the cup 22 end. As shown in FIG. 11, an adhesive 138, as described above with respect to the exemplary embodiments illustrated by FIG. 4 and FIG. 5, is present on at least part of the forward side of the center portion 132, such that the adhesive is encountered by one end of the coiled handbill 26, when inserted in the manner similar to that illustrated in FIG. 3. In some exemplary embodiments, the bottom member 130 is formed from a single material sheet.

Non-structural materials described above for the bottom member 34 of other exemplary embodiments, are suitable for the bottom members 100,110,130 depicted in FIGS. 6-11. In particular, the bottom members 100,110 illustrated in FIGS. 6-8 may be constructed from 20 pound bond paper and the bottom member 130 may be constructed from 40 pound card stock.

Other aspects, features and advantages of the present invention can be obtained from a study of the drawings, this disclosure, and the appended claims.

What I claim is:

1. A handbill assembly for a pneumatic ejection system, comprising:

a cup member consisting of a readily collapsible cylindrical wall, the cylindrical wall having an exterior surface, said cup member having a predefined internal diameter and two ends spaced apart at a predetermined distance, a nonstructural bottom member extending across one of said ends of the cylindrical wall and forming a closed end of said cup, and an open top at the other of said ends, said bottom member having a substantially circular planar portion and a plurality of elongated extensions joining said circular planar portion, said extensions having an adhesive, said extensions being foldable for adhesively secured disposition against the cylindrical wall exterior surface, said bottom member planar portion further having an adhesive exposed within said cup; and a handbill consisting of at least one sheet of paper rolled to form a coil having a length no more than about three times as long as the spaced distance between the ends of the cylindrical wall of the collapsible cup, a first portion extending along at least one-third of said coil length, a second portion extending along the remainder of said length, and an unrestrained diameter greater than the internal diameter of the cylindrical wall component of said cup, said first portion being disposed within the cup and said second portion extending outwardly from the open end of said cup, said first portion having an inserted end, the inserted end encountering at least some of the bottom member exposed adhesive.

2. A handbill assembly, as set forth in claim 1, wherein the bottom member planar portion adhesive is configured to leave part of the bottom member planar portion without exposed adhesive.

3. A handbill assembly, as set forth in claim 1, wherein the adhesive on each of the plurality of elongated extension adhesive is configured to leave part of each of the elongated extensions without adhesive.

4. A handbill assembly, as set forth in claim 1, wherein the number of elongated extensions is two.

5. A handbill assembly, as set forth in claim 1, wherein the number of elongated extensions is four.

6. A handbill assembly, as set forth in claim 1, wherein the nonstructural bottom member of said cup member is formed of single ply paper.

7. A handbill delivery system, comprising:

an elongated tube having a closed end, an open end spaced from said closed end, and a predetermined internal diameter;

a source of compressed fluid;

a control valve in fluid communication with said source of compressed fluid and the closed end of said tube;

a collapsible cup consisting of a cylindrical wall, the cylindrical wall having an exterior surface, said cup having an external diameter less than the internal diameter of said elongated tube and a pair of ends spaced apart at a predetermined distance, a nonstructural covering across one of said spaced ends forming a closed bottom of said collapsible cup, said closed bottom being disposed in a position facing the closed end of said elongated tube when said cup is assembled in the elongated tube, said covering further having a substantially circular planar portion and a plurality of elongated extensions joining the circular planar portion, the extensions having an adhesive, the extensions being foldable for adhesively secured disposition against the cylindrical wall exterior surface, said covering circular planar portion further having an adhesive exposed within the cup.

8. The handbill delivery assembly, as set forth in claim 7, wherein the covering circular planar portion adhesive is configured to leave part of the circular planar portion of the covering without exposed adhesive.

9. A handbill assembly, as set forth in claim 7, wherein the adhesive on each of the plurality of elongated extension adhesive is configured to leave part of each of the elongated extensions without adhesive.

10. A handbill assembly, as set forth in claim 7, wherein the number of elongated extensions is two.

11. A handbill assembly, as set forth in claim 7, wherein the number of elongated extensions is four.

12. A handbill assembly for a pneumatic ejection system, comprising:

a cup member consisting of a readily collapsible cylindrical wall, said cup member having:

a predefined internal diameter, an inside surface, and two ends spaced apart at a predetermined distance;

a nonstructural bottom member having a substantially planar and circular portion and a wall portion about the planar portion, the bottom member being sized such that the bottom member is closely received by one of said ends of the cylindrical wall forming a closed end of said cup, the bottom member planar portion extending across said end of the cylinder wall, and at least part of the bottom member wall portion bearing upon the cylindrical wall inside surface; and an open top at the other of said ends, said bottom member planar portion having an adhesive exposed within the cup; and a handbill consisting of at least one sheet of paper rolled to form a coil having a length no more than about three times as long as the spaced distance between the ends of the cylindrical wall of the collapsible cup, a first portion extending along at least one-third of said coil length, a second portion extending along the remainder of said length, and an unrestrained diameter greater than the internal diameter of the cylindrical wall component of said cup, said first portion extending being disposed within the cup and said second portion extending outwardly from the open end of said cup, said first portion having an inserted end, the inserted end encountering at least some of the bottom member exposed adhesive.

13. A handbill assembly, as set forth in claim 12, wherein the bottom member planar portion adhesive is configured to leave part of the bottom member without exposed adhesive.

14. A handbill assembly, as set forth in claim 12, wherein the nonstructural bottom member of said cup member is formed of single ply paper.

* * * * *